US005816396A

United States Patent [19]

Shin

[11] Patent Number: 5,816,396

[45] Date of Patent: Oct. 6, 1998

[54] PUTTER CASE AND METHOD

[76] Inventor: Byung Shin, 2500 White Rd., Irvine, Calif. 92714

[21] Appl. No.: 779,136

[22] Filed: Jan. 6, 1997

[51] Int. Cl.[6] ..... A63B 55/00

[52] U.S. Cl. ..... 206/315.3; 206/315.2

[58] Field of Search ..... 206/315.2, 315.3; 248/231.81, 205.2, 213.2, 96; 473/282, 287, 307, 313, 316; 211/70.2

[56] References Cited

U.S. PATENT DOCUMENTS

| | | | |
|---|---|---|---|
| 1,563,816 | 12/1925 | Worthington | 206/315.2 |
| 2,595,987 | 5/1952 | Shears | 211/70.2 X |
| 3,866,646 | 2/1975 | Nevard | 211/70.2 |
| 4,838,416 | 6/1989 | Carman | 206/315.2 |
| 4,932,523 | 6/1990 | Yamazoe | 206/315.2 X |
| 5,088,600 | 2/1992 | Kopp, Jr. | 206/315.2 |
| 5,332,090 | 7/1994 | Tucker | 206/315.3 |

*Primary Examiner*—Allan N. Shoap
*Assistant Examiner*—Tri M. Mai
*Attorney, Agent, or Firm*—John J. Connors; Connors & Associates

[57] ABSTRACT

A golf bag has removably attached to its exterior a device adapted to hold a putter. The device comprises an elongated tubular member having a closed bottom and an open top. The tubular member has a restricted diameter so that it can only hold a single putter, and a hook element attached to the tubular member near the open top. The hook element grasps said edge of the golf bag to attach the tubular member to the golf bag, with the tubular member extending lengthwise along the exterior of the golf bag.

13 Claims, 6 Drawing Sheets

26
28
32
32
46
18
10
16
24
12
12
38
12
14
40
42
22
20

5
5
6
7
7
100
100
108
18
16
110
112
102
104
106
12
18
16
102
106
27
29
104
100
31
12
18
102
100
104
112
102b
110
102a 102b
102
108
102a 102b
106
102a
104

104
106
112
102b
110a
16
18
108
102

112
104
12
110
108

FIG. 9
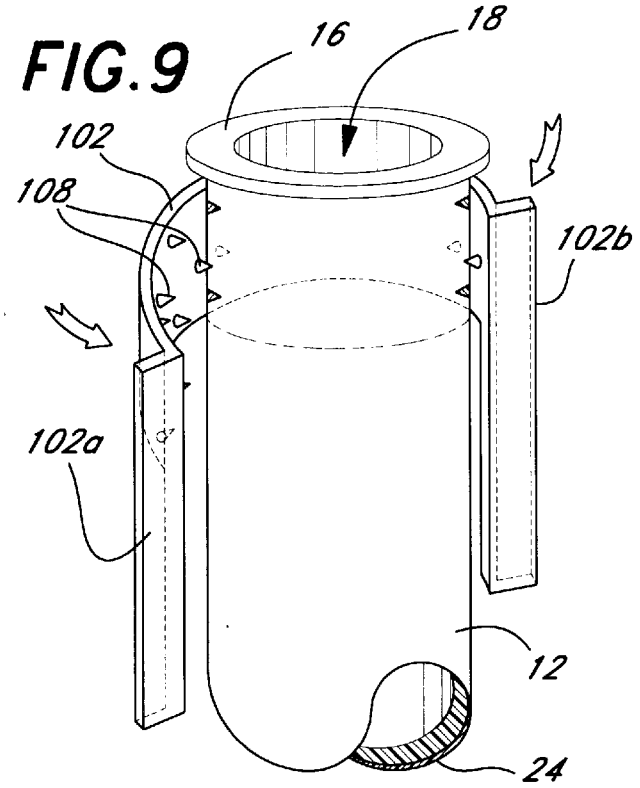
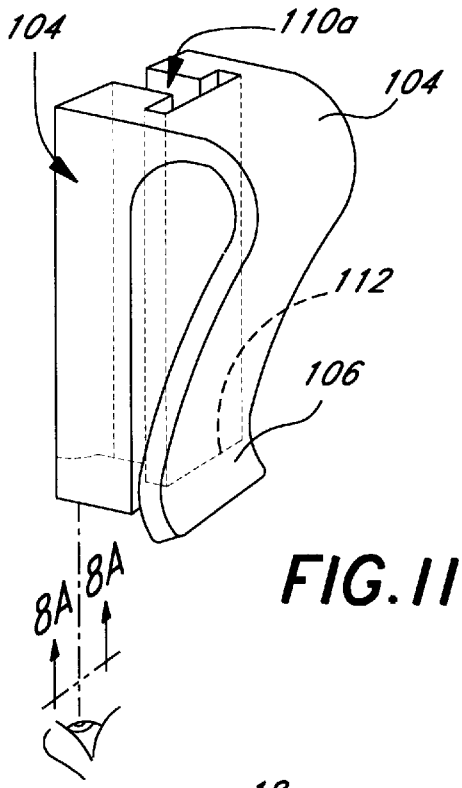
FIG. 11
FIG. 10
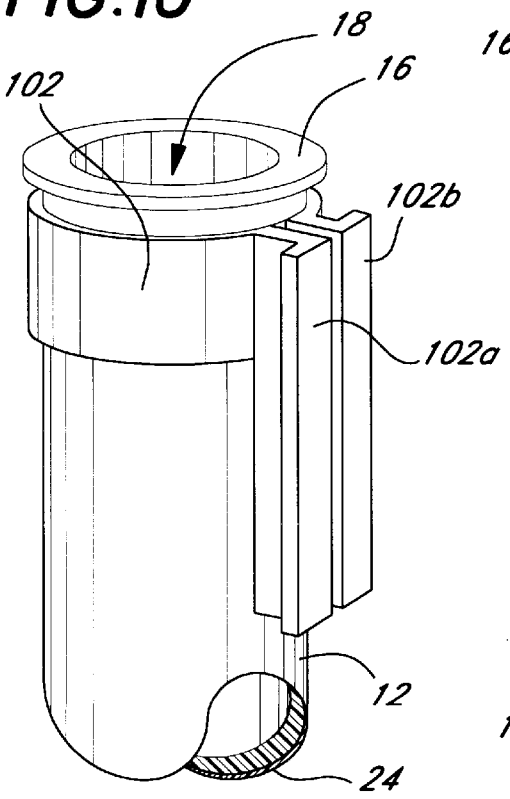
FIG. 12
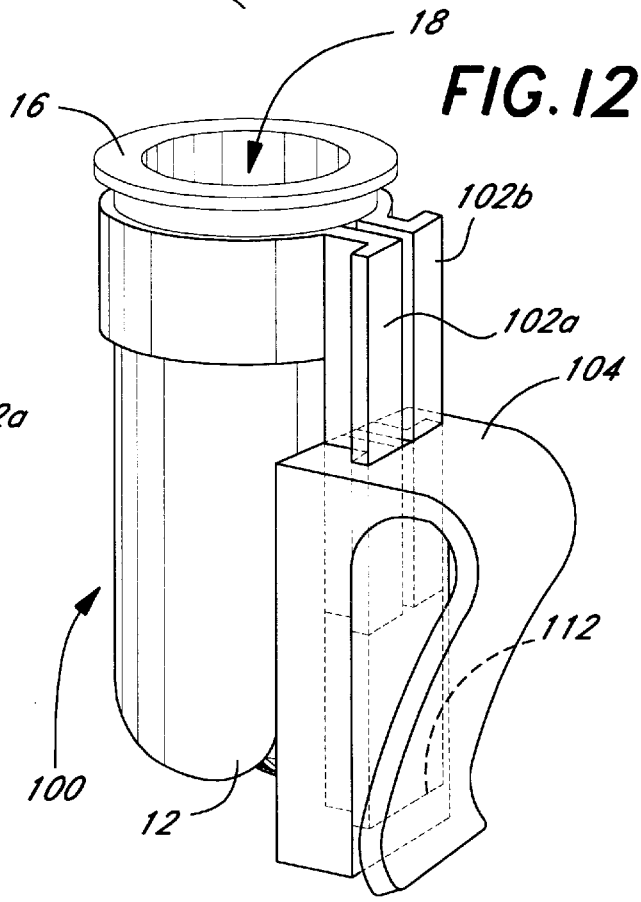

PUTTER CASE AND METHOD

BACKGROUND OF THE INVENTION

1. Field of the Invention

This invention relates to a device for holding a putter (or other golf equipment) on the exterior of a golf bag to thereby provide easy access to the putter.

2. Background Discussion

Putters are used on almost every hole a golfer plays. The putter is placed inside the receptacle portion of the golf bag, along with all the other clubs. Consequently, the golfer needs to sort through all the clubs to find the putter almost on every hole. The shaft of the putter is also shorter than the other clubs, and this makes it more difficult to find and also more likely to be damaged. It, therefore, would be desirable to isolate the putter from the other clubs. There are other devices, such as ball retrievers, and specialized clubs, which may also be used by the golfer. Sometimes, instead of isolating the putter from the rest of the clubs, it is desirable to isolate these other devices or specialized clubs.

SUMMARY OF THE INVENTION

It is the objective of this invention to provide a device and method for isolating a putter, or other special club or piece of golf equipment, from the other clubs in the golf bag.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience in locating a putter or other type of golf club or equipment, simplicity of use, ease of assembly, and low cost.

The first feature of the device of this invention is that it is adapted to hold a putter and to be removably attached to the exterior of a golf bag. The device includes an elongated tubular member having a closed bottom and an open top.

The second feature is that the tubular member has a restricted diameter so that it can only hold a single golf club or other special piece of golf equipment. Preferably, the tubular member has a cylindrical configuration with a diameter of from about ¾ to 2 inches. The tubular member may be covered with a sheet of water resistant material such as vinyl plastic or water proofed leather.

The third feature is a hook element attached to the tubular member near the open top for attaching the tubular member to the golf bag. The hook is placed over the edge of the open mouth of the receptacle portion of the golf bag, it retains the device in position but permits it to be easily removed when desired.

The fourth feature is that the hook element comprises a flexible band wrapped around the tubular member, with opposing ends of the band connected by a connector member including a hook. The circumference of the tubular member and the length of the band are approximately equal. The opposed ends of the band each have a flange member, and these flange members are next to each other upon wrapping the band around the circumference of the tubular member. Preferably, there are spike members protruding from the inside surface of the band which pierce the surface of the tubular member upon wrapping the band around the tubular member. The connector member includes a slot into which the flange members fit, with the slot terminating in a stop which limits the movement of the flange members. The slot is oriented, so that the combined weight of the tubular member and connector member tend to pull the flanges into the slot and against the stop when the hook is placed over the edge of the open mouth of the receptacle portion of the golf bag.

The fifth feature is that the interior surface of the tubular member nearby the open top is covered with a fabric material that minimizes the likelihood of damaging a shaft of a golf club placed inside the tubular member. Any suitable soft fabric may be used.

The sixth feature is a strap member near the bottom of the tubular member that may be attached to the golf bag by wrapping the strap around the golf bag. This secures the lower portion of the device in place next to the exterior surface of the golf bag.

This invention also includes a method of carrying a putter and the like by placing the putter in an easy to access location on the exterior of a golf bag. This method includes:

(a) providing a device including an elongated tubular member having a closed bottom and an open top, said tubular member having a restricted diameter so that it can only hold a single putter, and a hook element attached to the tubular member near the open top for attaching the tubular member to the golf bag, (b) removably attaching the device to the golf bag by placing the tubular member next to the exterior of the golf bag and engaging said hook element with an edge of the golf bag forming an open mouth into which clubs a placed, and (c) inserting the putter lengthwise into the tubular member.

BRIEF DESCRIPTION OF THE DRAWING

The preferred embodiment of this invention, illustrating all its features, will now be discussed in detail. This embodiment depicts the novel and non-obvious putter case and method of this invention as shown in the accompanying drawing, which is for illustrative purposes only. This drawing includes the following figures (FIGURES), with like numerals indicating like parts:

FIG. 9 is a perspective view showing the band partially wrapped around the top end of the device shown in FIG. 4.

FIG. 10 shows the band completely wrapped around the top end of the device shown in FIG. 4.

FIG. 11 is a perspective view of the connector member used with the device shown in FIG. 4.

FIG. 12 shows the connector member being slid over the flanged ends of the band.

DETAILED DESCRIPTION OF THE PREFERRED EMBODIMENTS

First Embodiment

Figure 1:
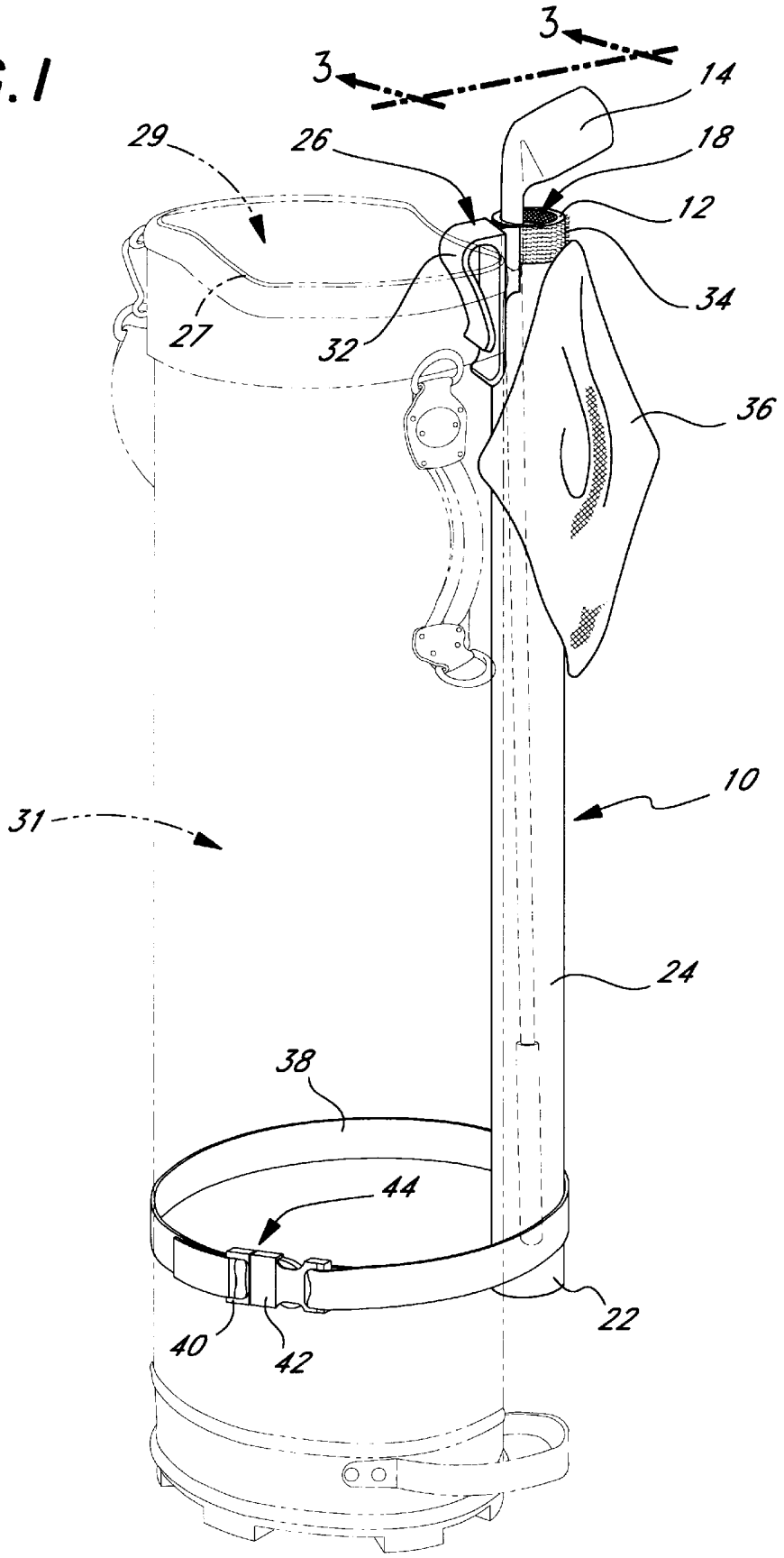
FIG. 1 is a perspective view showing one embodiment of the device of this invention attached to a golf bag (shown in phantom).
Figure 2:
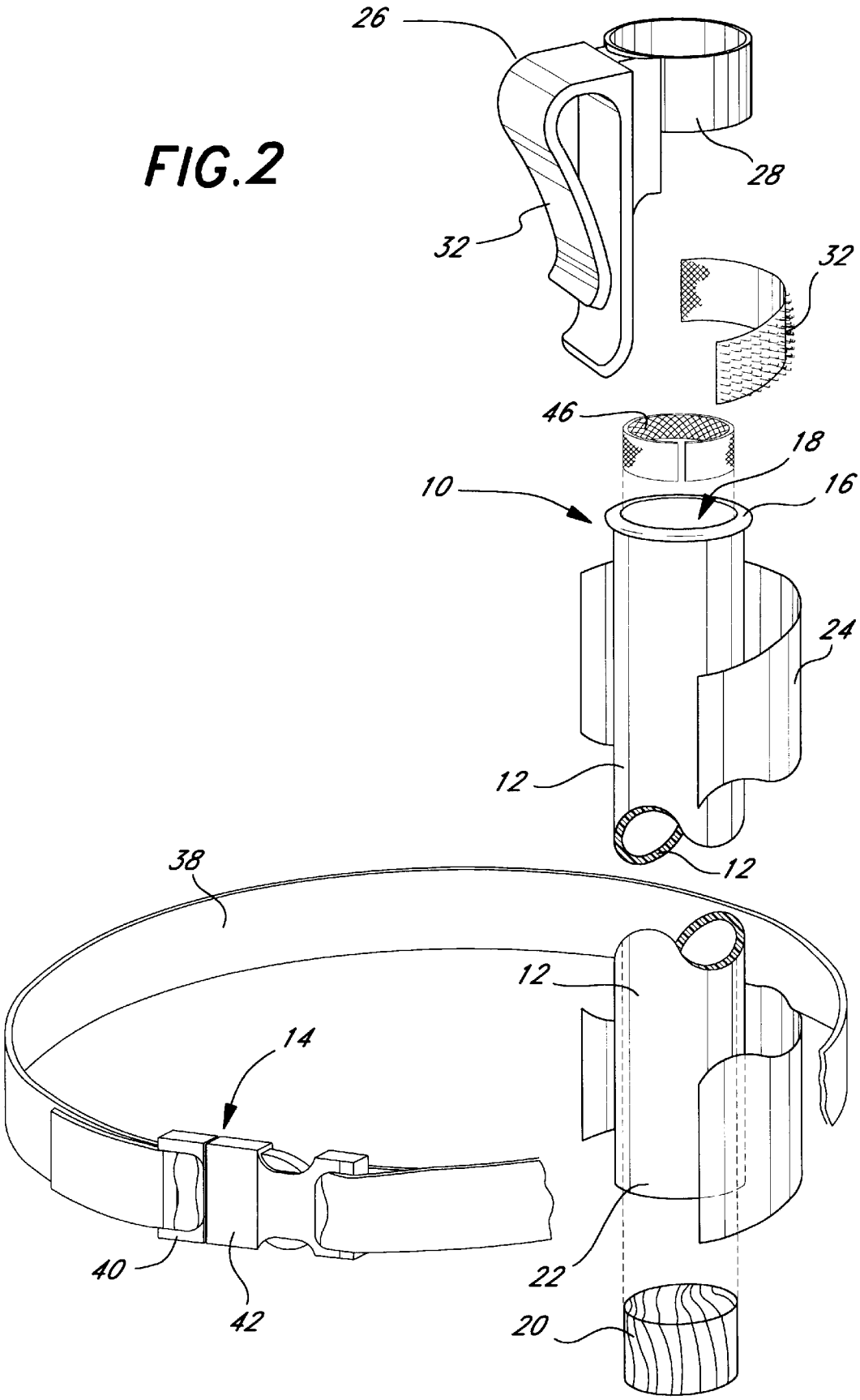
FIG. 2 is an exploded perspective view of the device shown in FIG. 1.
Figure 3:
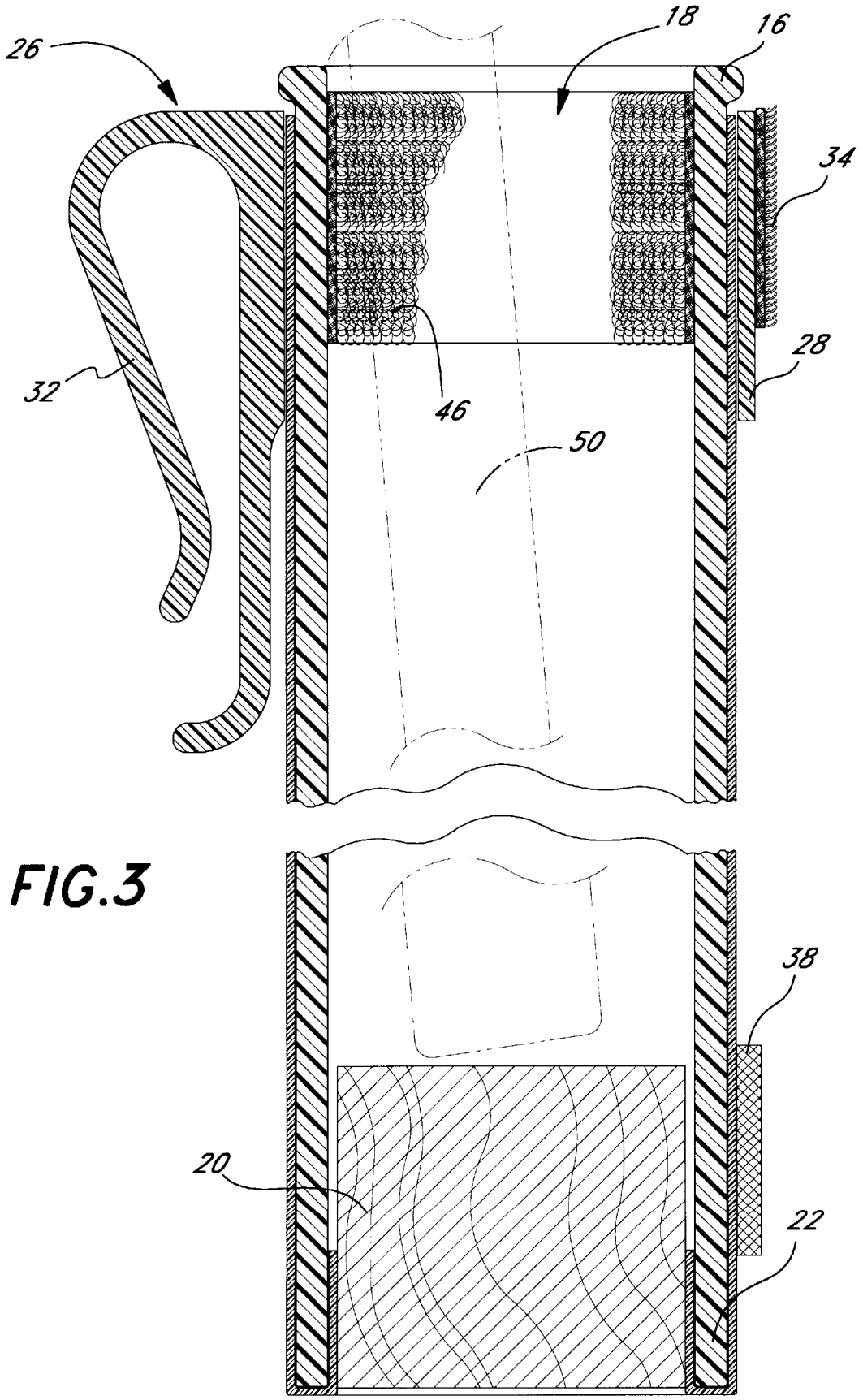
FIG. 3 is a cross-sectional view taken along line 3—3 of FIG. 1.
Figures 4, 5, 6:
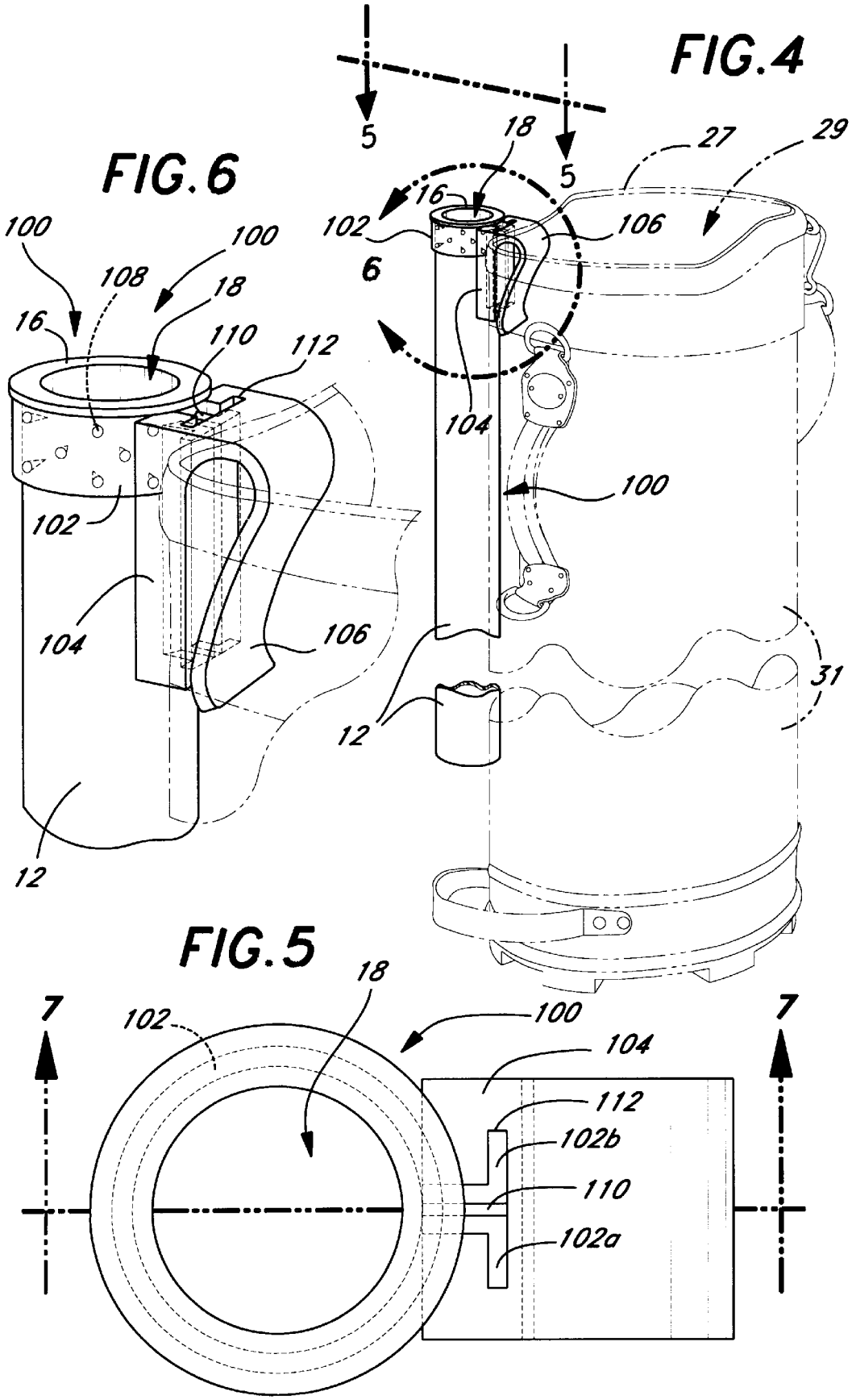
FIG. 4 is a perspective view showing another embodiment of the device of this invention attached to a golf bag (shown in phantom).
FIG. 5 is a cross-sectional view taken along line 5—5 of FIG. 4.
FIG. 6 is an enlarged fragmentary perspective view of the device shown in FIG. 4.

As best shown in FIGS. 1, 2 and 3, the first embodiment of the device 10 of this invention includes a tubular member 12 having a restricted diameter of approximately from ¾ to 2 inches, that is adapted to hold only a single golf club 14, for example, a putter or wedge, or another piece of golf equipment such as a golf ball retriever. The tubular member 12 has a generally cylindrical shape with a lip 16 at the open end 18 of the member. A plug 20 is inserted into the bottom 22 of the tubular member 12 to close off and seal the bottom. The exterior of the tubular member 12 optionally may be covered with a vinyl or leather sheet material 24 for aesthetic reasons. This sheet material 24 is bonded by an adhesive to the exterior of the tubular member 12.

At the open end 18 of the tubular member 12 is a clip 26 for removably attaching the device 10 to the edge 27 of an open mouth 29 of the receptacle portion of a golf bag 31. The clip 26 includes a ring 28 which surrounds the open end of the tubular member and abuts the underside of lip 16 and a hook element 32 securely attached to the ring. The ring 28 is bonded by an adhesive to the exterior surface of the sheet material 24 and is fixed too the tubular member 12 to hold the clip 26 in position adjacent the open end 18 of the tubular member 12.

Preferably, there is around the exterior of the ring 28 and bonded to the ring by an adhesive a hook element 34 of a hook and fabric type connector. This enables, for example, a golf towel 36 to be attached to the device 10 by simply pushing the towel against the hook element 34. Velcro Corporation makes a suitable hook element 34. On the interior of the tubular element at the open end 18 is a fabric material 46. This fabric material 46 may be woven or non-woven, and it serves to protect the shaft 50 (FIG. 3) of a putter (or other club) upon inserting the club into the tubular member 12.

Near the bottom 22 of the tubular member 12 is a strap 38 attached to the sheet material 24, for example, by sewing. The strap 38 has at opposite ends, respectively, a male element 40 and a female element 42 of a clasp 44 for securing the ends of the strap together. This strap 38 thus holds the lower portion of the device 10 snug against the exterior of the golf bag 31, when the device 10 is attached to the golf bag 31.

To use this invention, the golfer simply forces the hook element 34 over the edge 27 surrounding the open mouth 29 of the golf bag 31, and then wraps the strap 38 around the exterior of the lower section of the golf bag, bringing the male element 40 and female element 42 together to close the clasp 44. Upon inserting, for example, the golf club 14 into the interior of the tubular member 12, the shaft 50 will rub against the fabric material 46 to avoid or minimize any damage. This is especially important with graphite shafts. To detach the device 10, the hook element 34 is simply slipped off the edge after first opening the clasp 44 by decoupling the male element 40 and female element 42.

Although golfers are most likely to use the device 10 of this invention in connection with isolating putters from the remainder of the clubs contained within the receptacle portion of the golf bag 31, this device may also be used for holding golf ball retrievers or other specialized clubs such as wedges or chippers. Because the diameter of the tubular member 12 is restricted, it will hold only one golf club. With the device 10 mounted on the exterior of the golf bag 31, not only is the golf club isolated from the other clubs in the receptacle portion of the golf bag, the isolated golf club is always handy and the golfer does not have to sort through all the clubs in the golf bag to find the isolated club or other piece of golf equipment contained in the device.

Second Embodiment

As best shown in FIGS. 4 through 11, the second embodiment of this invention, the device 100, also includes the tubular member 12 having a generally cylindrical shape with the lip 16 at the open end 18 of the member. The exterior of the tubular member 12 optionally may be covered with a vinyl or leather sheet material 24.

Figures 7, 8A, 8B:
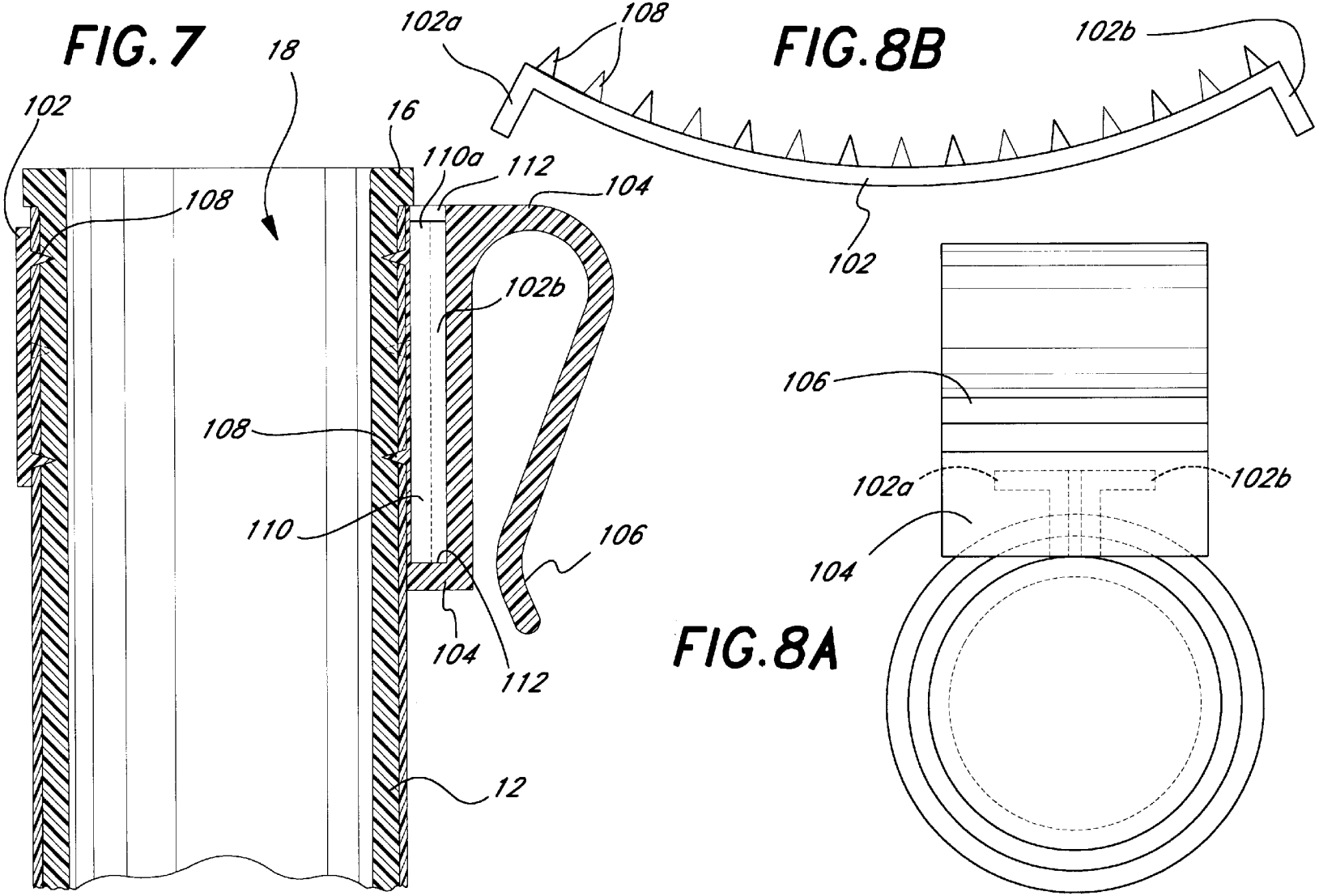
FIG. 7 is a cross-sectional view taken along line 7—7 of FIG. 5.
FIG. 8A is cross-sectional view taken along line 8A—8A of FIG. 11.
FIG. 8B is a top plan view of the band prior to being wrapped around the tubular member.

In accordance with one feature of this invention, there is a flexible band 102 wrapped around the tubular member 12, with opposing ends of the band connected by a connector member 104 including a hook 106. As shown in FIG. 8B, the band 102 is normally elongated, but it is flexible so that it may be wrapped around the tubular member 12 as shown in FIGS. 9 and 10. The circumference of the tubular member 12 and the length of the band 102 are approximately equal.

The flexible band 102 may be made of a polymeric material such as polyethylene and it has opposed ends which each have a flange member 102*a* and 102*b*. These flange members 102*a* and 102*b* are next to each other, preferably abutting, upon wrapping the band 102 around the circumference of the tubular member 12. As shown in FIG. 10, when next to each other, the flange members 102*a* and 102*b*, in cross-section, have a substantially T-shape configuration. Preferably, there are spikes 108 protruding from the inside surface of the band 102 which pierce the surface of the tubular member 12 upon wrapping the band around the tubular member.

The connector member 104 includes a slot 110 into which the flange members 102*a* and 102*b* fit. The slot 110 has a substantially T-shape configuration about the same dimensions as the T-shape configuration of the abutting, or near abutting, flange members 102*a* and 102*b* when in the position shown in FIG. 10. The slot 110 has an open top end 110*a* and terminates at an internal end to provide a stop wall 112 that limits the movement of the flange members 102*a* and 102*b* into the slot. The connector member 104 is positioned beneath the band 102 which has been located near the open end 18 and wrapped around the exterior of tubular member 12. The connector member 104 is then pushed upward to slip the flange members 102*a* and 102*b* into the T-shaped slot 110. The inside ends of the flange members 102*a* and 102*b* engage the stop wall 112, so that essentially the entire body of each of the flange members is within the slot 110 upon assembly of the band 102 and the connector member 110.

With the connector member 104 attached to the flange members 102*a* and 102*b*, the hook 106 is positioned to engage to the edge 27 of an open mouth 29 of the receptacle portion of a golf bag 31 when the device 100 is placed on the bag. The slot 110 is oriented with its open end 110*a* near the open end 18 of the tubular member 12, so that the combined weight of the putter, tubular member and connector member 104 tend to pull the flange members 102*a* and 102*b* into the slot and against the stop wall 112 when the hook 106 is placed over the edge 27 of the open mouth 29 of the receptacle portion of the golf bag 31.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

I claim:

1. A removable device for holding a putter and other golf equipment to the exterior of a golf bag and including an elongated tubular member having a bottom and an open top, said tubular member having a restricted diameter so that it can only hold a single putter, and a hook element attached to the tubular member near the open top for attaching the tubular member to the golf bag, said hook element including a flexible band wrapped around the tubular member and said band having opposed ends connected by a connector member which includes a hook for attaching to the exterior of a golf bag.

2. The device of claim 1 where the exterior of the tubular member is covered with a sheet of water resistant material.

3. The device of claim 2 where the sheet of water resistant material is selected from the group consisting of a vinyl plastic and leather.

4. The device of claim 1 where the tubular member has a substantially cylindrical configuration with a circumference of a predetermined dimension, and the opposed ends of the band each have a flange member, said band having a length approximately equal to the circumference of the tubular member, with the flange members being next to each other upon wrapping the band around the circumference of the tubular member.

5. The device of claim 4 where the connector member includes a slot into which the flange members fit, said slot terminating in a stop which limits the movement of the flange members.

6. The device of claim 5 where there are spike members protruding from an inside surface of the band which pierce the tubular member upon wrapping the band around the tubular member.

7. The device of claim 4 where the slot is oriented, so that the combined weight of the tubular member and connector member tend to pull the flange members into the slot when the hook is placed over an edge of an open mouth of a receptacle portion of the golf bag.

8. The combination of a golf bag and a device to hold a putter said golf bag having an exterior and a edge defining an open mouth into which golf clubs are inserted and withdrawn, said device comprising an elongated tubular member having a bottom and an open top, said tubular member having a restricted diameter so that it can only hold a single putter, and a hook element attached to the tubular member near the open top which grasps said edge of the golf bag to attach the tubular member to the golf bag, with the tubular member extending lengthwise along the exterior of the golf bag, said hook element including a flexible band wrapped around the tubular member, and said band having opposed ends connected by a connector member which includes a hook for attaching to the exterior of a golf bag.

9. The combination of claim 8 where the tubular member has a substantially cylindrical configuration with a circumference of a predetermined dimension, and the opposed ends of the band each have a flange member, said band having a length approximately equal to the circumference of the tubular member, with the flange members being next to each other upon wrapping the band around the circumference of the tubular member.

10. The combination of claim 9 where the connector member includes a slot into which the flange members fit, said slot terminating in a stop which limits the movement of the flange members.

11. The combination of claim 9 where there are spike members protruding from an inside surface of the band which pierce the tubular member upon wrapping the band around the tubular member.

12. The combination of claim 11 where the slot is oriented, so that the combined weight of the tubular member and connector member tend to pull the flange members into the slot when the hook is placed over an edge of an open mouth of a receptacle portion of the golf bag.

13. A method of carrying a putter by placing the putter in an easy to access location on the exterior of a golf bag, including (a) providing a device including an elongated tubular member having a bottom and an open top, said tubular member having a restricted diameter so that it can only hold a single putter, and a hook element attached to the tubular member near the open top for attaching the tubular member to the golf bag, said hook element including a flexible band wrapped around the tubular member, and said band having opposed ends connected by a connector member which includes a hook attaching to the exterior of a golf bag, (b) removably attaching the device to the golf bag by placing the tubular member next to the exterior of the golf bag and engaging said hook element with an edge of the golf bag forming an open mouth into which clubs a placed, and (c) inserting the putter lengthwise into the tubular member.

* * * * *